US008284112B2

(12) United States Patent
Otto et al.

(10) Patent No.: US 8,284,112 B2
(45) Date of Patent: Oct. 9, 2012

(54) ANTENNA ORIENTATION DETERMINATION

(75) Inventors: Troy Otto, Aurora, CO (US); Harold Jaramillo, Castle Rock, CO (US); Joseph E. Tomko, Castle Rock, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 365 days.

(21) Appl. No.: 12/796,542

(22) Filed: Jun. 8, 2010

(65) Prior Publication Data

US 2011/0298672 A1 Dec. 8, 2011

(51) Int. Cl.
*H01Q 3/00* (2006.01)

(52) U.S. Cl. ..... 343/765; 766/757

(58) Field of Classification Search ..... 343/765, 343/766, 757, 760; 342/359
See application file for complete search history.

(56) References Cited

U.S. PATENT DOCUMENTS 6,016,120 A 1/2000 McNabb et al.
6,850,202 B2 * 2/2005 Watson ..... 343/766
6,906,673 B1 * 6/2005 Matz et al. ..... 343/760
2001/0046258 A1 11/2001 Wise et al.
2002/0084948 A1 7/2002 Watson
2007/0040687 A1 2/2007 Reynolds
2008/0258971 A1 * 10/2008 Nichols et al. ..... 342/359

FOREIGN PATENT DOCUMENTS

WO 0010224 A1 2/2000
WO 2006116695 A2 11/2006

OTHER PUBLICATIONS

"3-Axis Digital Compass IC HMC5843", Honeywell International Inc. publication, Feb. 2009, Form #900367, 19 pages.

* cited by examiner

*Primary Examiner* — Hoang V Nguyen
(74) *Attorney, Agent, or Firm* — Lowe Graham Jones PLLC

(57) ABSTRACT

A method of determining a current orientation of an antenna compared to a desired orientation is presented. In the method, current orientation data indicating a current orientation of the antenna is generated in circuitry mounted to the antenna. Data indicating a desired orientation for the antenna at the geographical location of the antenna is received. The desired orientation data is compared with the current orientation data. Based on this comparison, alignment information is generated which indicates whether the current orientation of the antenna aligns with the desired orientation of the antenna.

21 Claims, 6 Drawing Sheets

ANTENNA ORIENTATION DETERMINATION

BACKGROUND

Many communication antennas are "directional" in that they must be aligned in a desired direction, or must maintain a specific orientation, in order to transmit communication signals to, and/or receive communication signals from, a particular remote communication device or system. One example of such an antenna is a parabolic "dish" antenna typically associated with Direct Broadcast Satellite (DBS) and related satellite television systems. Such an antenna typically must be directed at the intended source satellite within a relatively small angular tolerance to allow the parabolic surface of the antenna to direct the received television signals to a low-noise block-converter (LNB) or similar signal-receiving circuitry of the antenna to capture the television programming reliably.

During the antenna installation process, a satellite system installer typically employs the television receiver or "set-top box" connected to the antenna, or a separate electronic device, to monitor the strength or intensity of the satellite signal being received as the installer alters the angular orientation of the antenna to search for the orientation at which the received signal strength is maximized. To this end, the installer adjusts the antenna orientation in any or all of three angular directions: azimuth (i.e., left and right parallel to the horizon), elevation (i.e., up and down perpendicular to the horizon), and polarization or "skew" (i.e., rotationally about a central axis perpendicular to, and passing through, the dish portion of the antenna).

Generally, the angular adjustment process is painstaking, and may sometimes result in a less-than-optimum antenna orientation due to the difficulty inherent in altering three separate angles of the antenna representing three degrees of freedom while searching for the maximum signal strength. Furthermore, even if the initial angular adjustment of the antenna made during installation is accurate, events such as high winds and unintentional contact with the antenna may move the antenna from its desired orientation, typically resulting in unacceptable signal reception. Moreover, such a lack of signal strength may also occur as a result of foliage obstructions, electronic failures, and other causes, making a definitive diagnosis of antenna misalignment uncertain without an on-site customer service call.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

The enclosed drawings and the following description depict specific embodiments of the invention to teach those skilled in the art how to make and use the best mode of the invention. For the purpose of teaching inventive principles, some conventional aspects have been simplified or omitted. Those skilled in the art will appreciate variations of these embodiments that fall within the scope of the invention. Those skilled in the art will also appreciate that the features described below can be combined in various ways to form multiple embodiments of the invention. As a result, the invention is not limited to the specific embodiments described below, but only by the claims and their equivalents.

Figure 1:
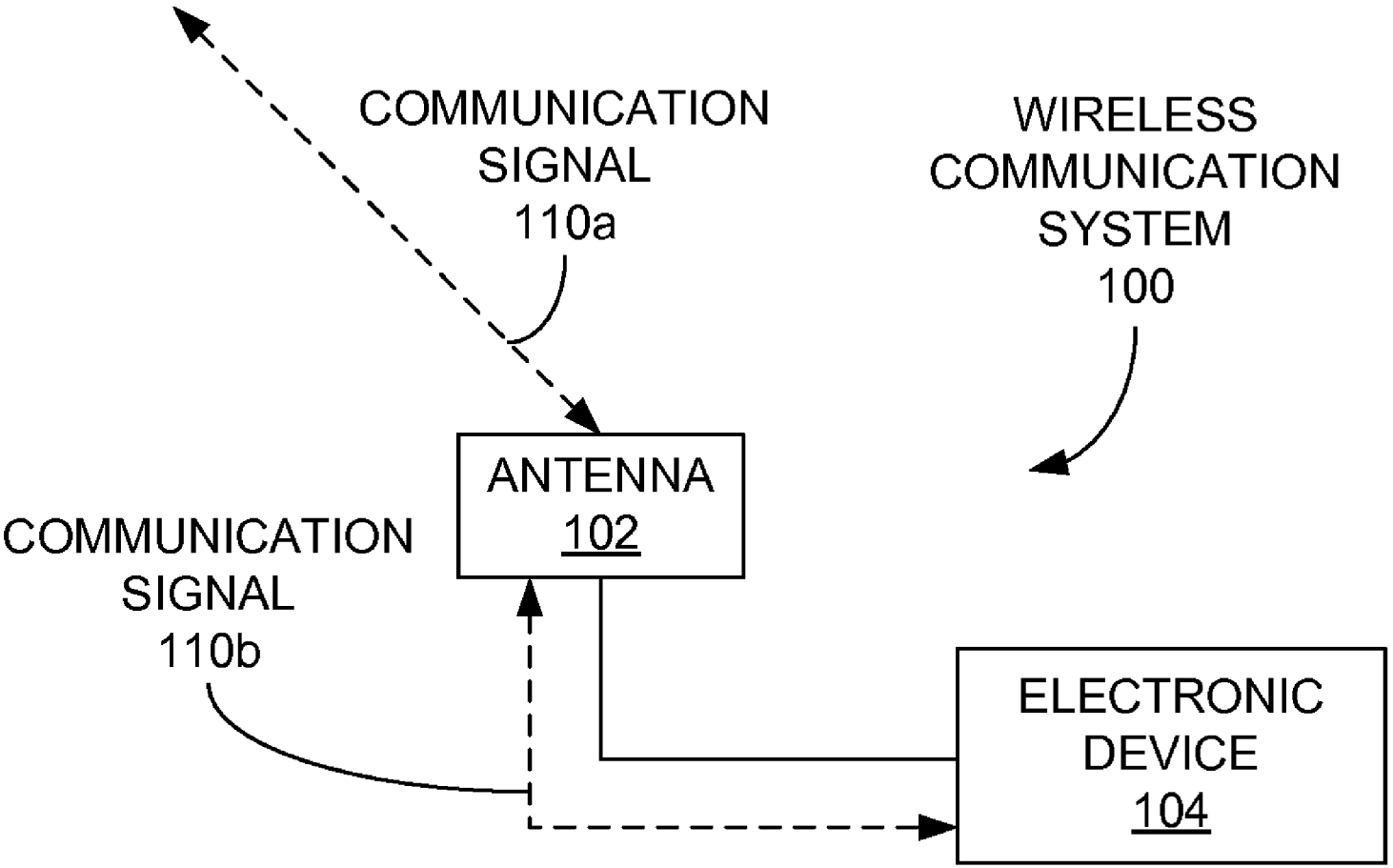
FIG. 1 is a simplified block diagram of a wireless communication system according to an embodiment of the invention.

FIG. 1 illustrates a wireless communication system 100 including an electronic device 104 communicatively coupled with an antenna 102. If the electronic device 104 is configured as a communication receiver, the antenna 102 is configured to receive a wireless communication signal 110*a* from a communication signal source, such as a satellite or terrestrial transmission antenna, potentially process the received signal 110*a*, and then transfer the resulting communication signal 110*b* to the electronic device 104. In addition to, or in lieu of, performing as a communication receiver, the electronic device 104 may operate as a communication transmitter or source, transmitting the communication signal 110*b* to the antenna 102, which may process and transmit the resulting wireless communication signal 110*a*.

The electronic device 104 may be a broadcast transmitter or receiver, such as that employed for terrestrial or satellite television and radio signals. In other embodiments, the electronic device 104 may employ any other type of wireless signals received or transmitted via an antenna.

Similarly, the antenna 102 may be any antenna for the transmission or reception of wireless communication signals 210*a*. The antenna 102 may also process the received communication signal 110, such as frequency down-conversion or up-conversion, amplification, and filtering prior to forwarding or retransmitting the signal 110 toward its ultimate destination. Additionally, the antenna 102 includes a structure or surface configured to send or receive communication signals 110*a* in a particular direction defined by the structure or surface. As a result, the particular physical orientation of the antenna 102 in at least one of three angular directions, such as azimuth, elevation, and/or skew, directly impacts the strength and/or quality of a communication signal 110*a* transmitted to or received from a particular point or area in space.

For example, the actual orientation of a satellite television antenna, such as one employed in a DBS system, may be required to align with a particular satellite of interest within some tolerance level in order to receive a television signal of sufficient strength to properly down-convert and decode the signal for presentation to a user. Such an orientation may require the antenna to be correctly aligned in each of the azimuth, elevation, and skew directions within some error level (e.g., within less than an angular degree) of a desired antenna orientation.

In other examples, the antenna may only be required to be aligned in one or two angular directions, with antenna alignment of the other angular directions not being as critical. For example, a terrestrial television antenna may be mounted on a vertical pole or similar structure so that the antenna is aligned in a generally upright position, thus eliminating the need to accurately align the elevation or skew of the antenna. In that case, the only adjustable angle of concern may be the azimuth of the antenna so that the antenna may receive signals from a specific ground-based transmission tower.

Generally, for wireless communication antennas 102 that are not of an omni-directional nature, the physical orientation of the antenna 102 in at least one angular direction relative to the earth affects the ability of the antenna to transmit and/or receive communication signals properly. In the situations described above, the "communication" may involve signals purposely transmitted between two specific devices, such as a satellite and a ground-based antenna. In other examples, the antenna may be physically directed to a particular point or area without a specific known source or destination of the communication signals. For example, antennas employed for space exploration, surveillance, and the like, that may be employed to transmit and/or receive communication signals not readily identified with a particular source, destination, or type of signal, may also be regarded as communication antennas capable of employing the various concepts described hereinafter.

Figure 2:
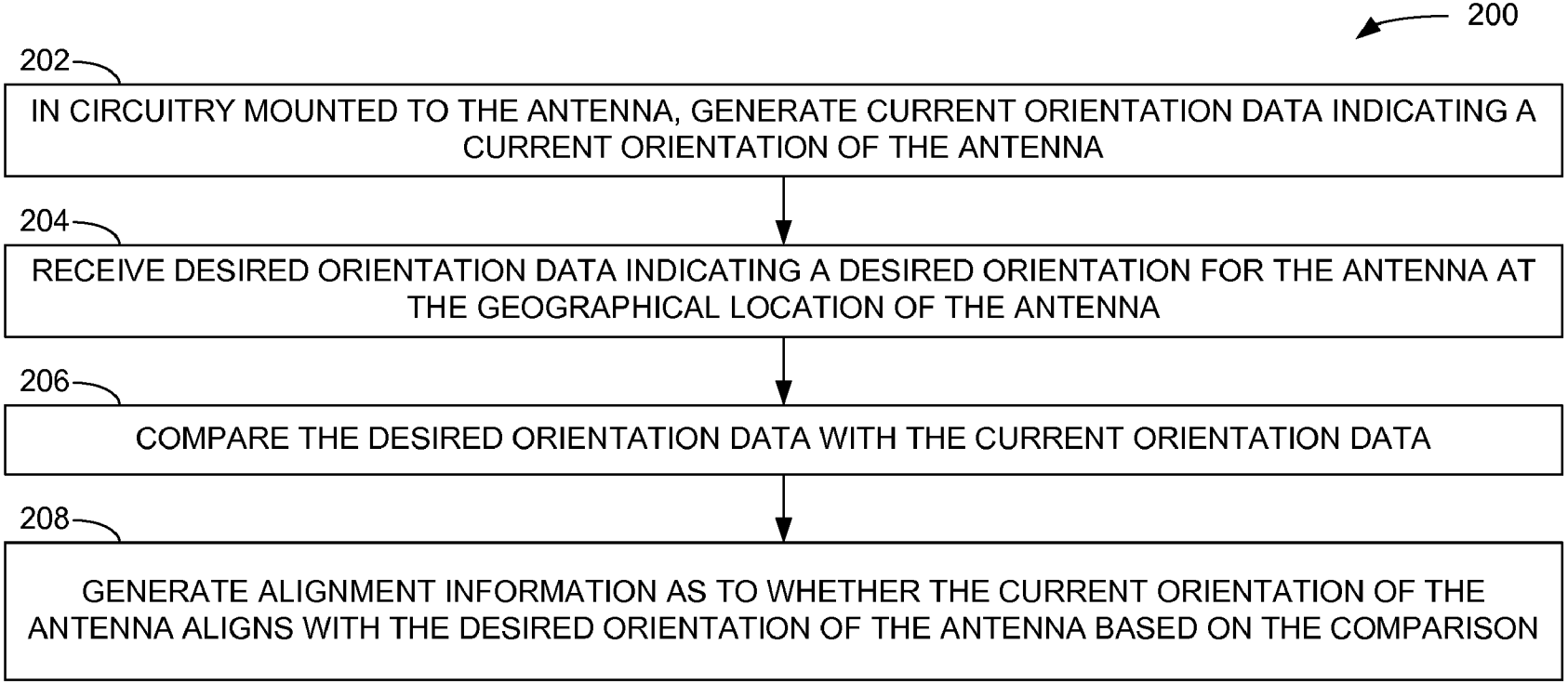
FIG. 2 is a flow diagram of a method according to an embodiment of the invention of determining a current orientation of an antenna compared to a desired orientation.

Using FIG. 1 for reference, FIG. 2 presents a method 200 of determining a current orientation of an antenna 102 compared to a desired orientation. In the method 200, current orientation data indicating a current orientation of the antenna 102 is generated in circuitry mounted to the antenna 102 (operation 202). Desired orientation data indicating a desired orientation for the antenna 102 at the geographical location of the antenna is received (operation 204). The desired orientation data is compared with the current orientation data (operation 206). Alignment information as to whether the current orientation of the antenna 102 aligns with the desired orientation of the antenna is then generated based on the comparison (operation 208).

In other embodiments, a computer-readable storage medium may have encoded thereon instructions for a processor or other control circuitry of the antenna 102 or the electronic device 104 of the communication system 100 to implement the method 200.

As a result of employing the method 200, the current alignment of the antenna 101 may be determined in a direct manner without having to rely on signal strength, as described above, or other less accurate proxies for checking proper antenna alignment. In some implementations, the signal strength may be considered in conjunction with the alignment measurement to determine if the antenna 101 is aligned correctly. Additional advantages may be recognized from the various implementations of the invention discussed in greater detail below.

Figure 3:
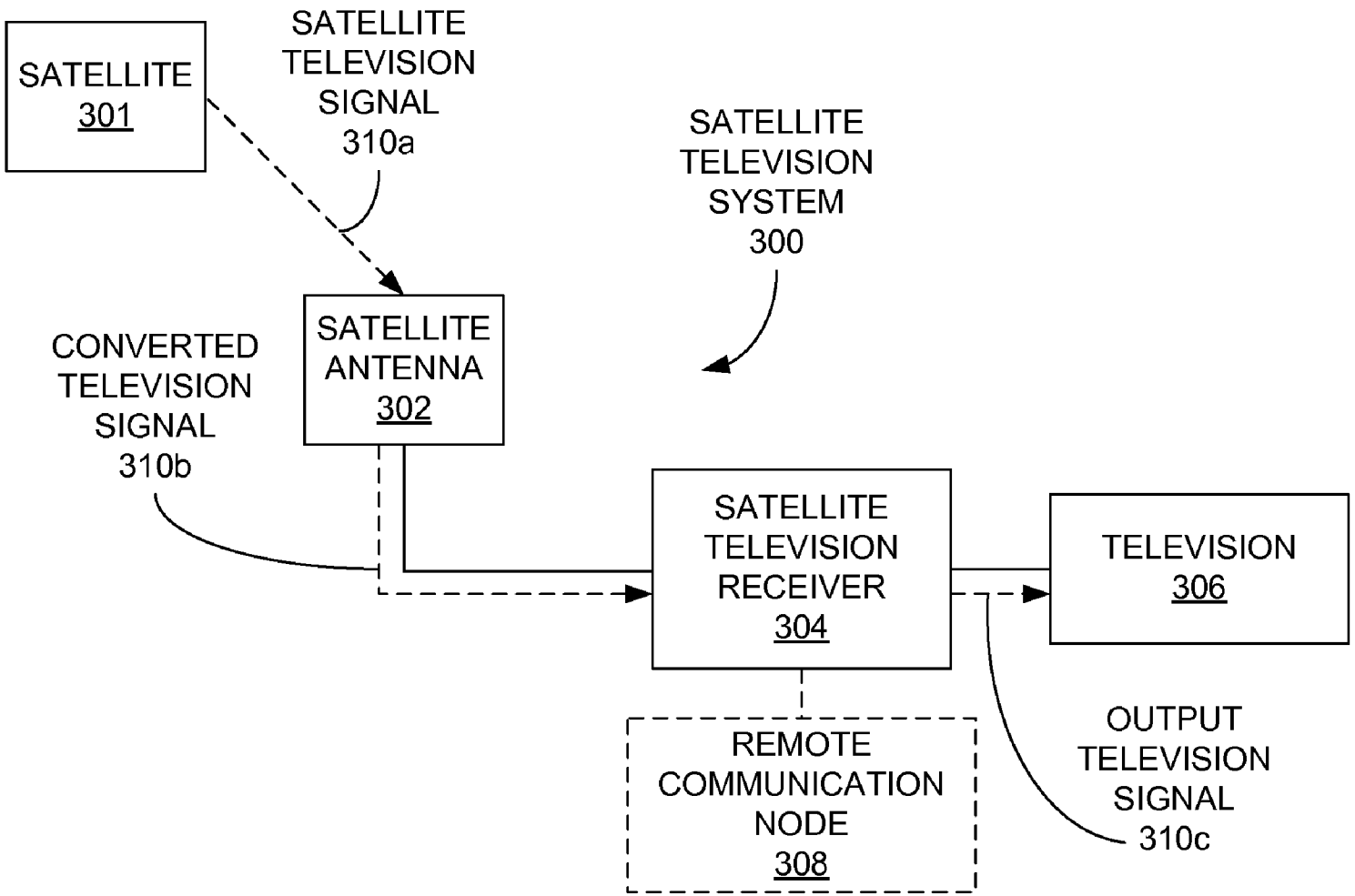
FIG. 3 is a block diagram of a satellite television system according to an embodiment of the invention.

FIG. 3 illustrates a satellite television system 300 that includes a satellite television receiver 304 connected to a satellite antenna 302. The satellite antenna 302 receives one or more satellite television signals 310*a* carrying television content received from a satellite uplink center (not shown in FIG. 3) by way of one or more transponders resident in a satellite 301 in geosynchronous orbit. The satellite antenna 302 then down-converts the frequencies of the satellite television signal 310*a* and forwards the resulting converted television signal 310*b* to the satellite television receiver 304.

The satellite television receiver or set-top box 304 then further processes the converted television signals 310*b*, selects at least one television program or channel under control of a user of the receiver 304, formats the channel or program for output, and then outputs the resulting output television signal 310*c* to at least one television 306 for presentation to the user. Also, the receiver 304 may be communicatively coupled with a remote communication node 308, which may be a node operated by a service provider of the satellite television signal 310*a*.

Figure 4:
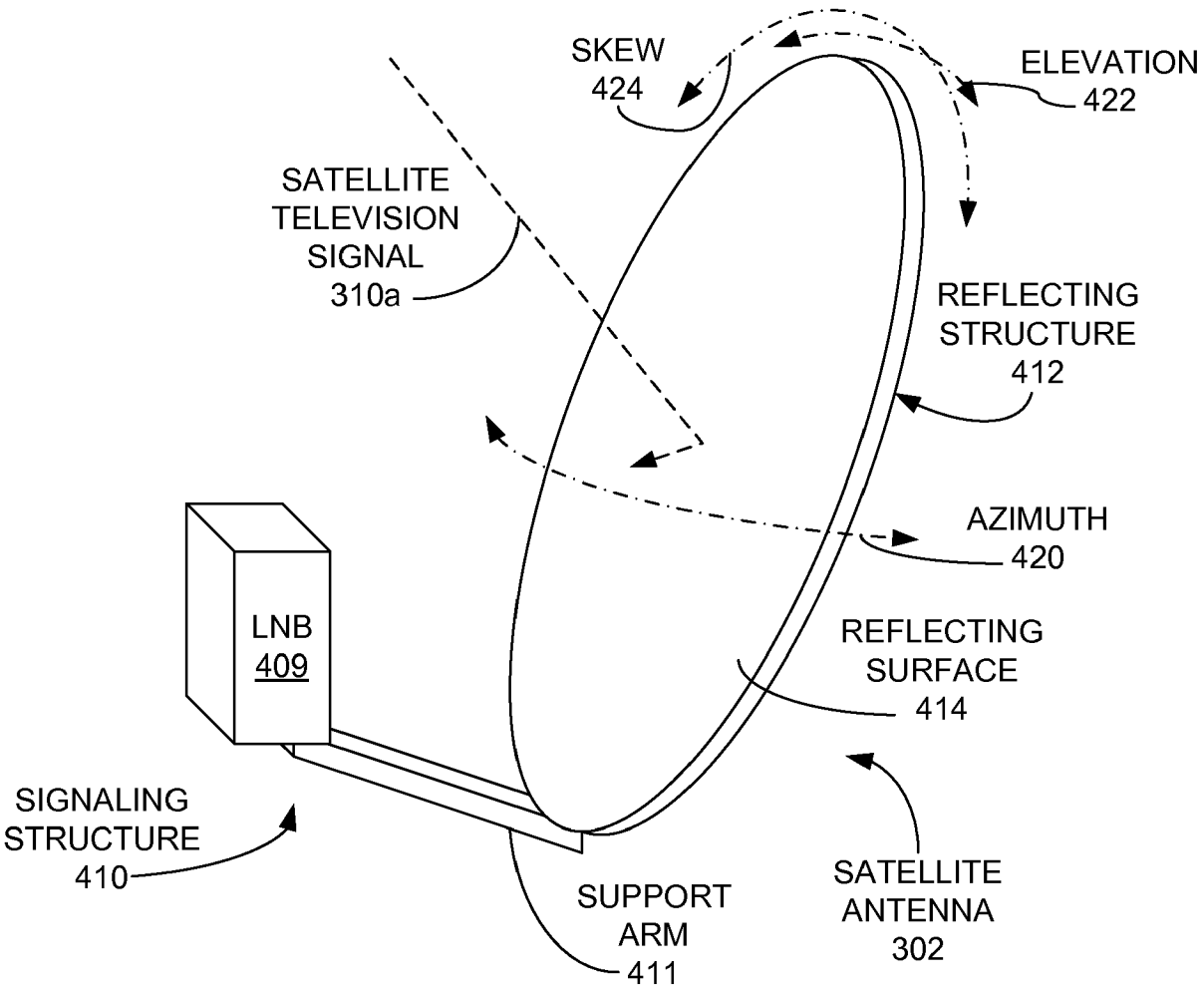
FIG. 4 is a perspective view of a satellite antenna of the satellite television system of FIG. 3 according to an embodiment of the invention.

FIG. 4 presents a perspective view of the satellite antenna 302 of FIG. 3 according to one embodiment. The satellite antenna 302 is configured as a typical parabolic or "dish" antenna 302 having a reflecting structure 412 with a reflecting surface 414 designed to receive the wireless television signal 310*a* and reflect the signal 310*a* to a signaling structure 410. Typically, the signaling structure 410 includes a signal receiving device, such as a low-noise block-converter (LNB) 409 adapted to receive the incoming wireless television signal 310*a*, down-convert the frequencies of the signal 310*a*, and forward the signal to the satellite television receiver 304 by way of coaxial cable (not explicitly shown in FIG. 4) or other means. A support arm 411 connects the LNB 409 with the reflecting structure 412 and correctly positions the LNB 409 to receive the reflected wireless signal 310*a* from the reflecting surface 414. Generally, the reflecting surface, and thus the antenna 302 in general, must be oriented correctly relative to the desired satellite 301 to receive the wireless television signal 310*a* from the satellite 301. Further, while FIG. 4 depicts a single television signal 310*a* being received from a single satellite 301, the LNB 409 may include circuitry allowing simultaneous reception of signals 310*a* from multiple satellites 301 when the antenna 302 is aligned in one specific orientation.

In one implementation, the desired orientation of the antenna 302 depends at least upon the orbits or locations of the satellites or satellites 301 from which signals 310*a* are to be received, and the geographical location of the antenna 302. Such information may be sufficient to determine the proper angle, and thus the desired orientation, of the antenna 302. In another example, the type or structure of the antenna 302 may also be needed to determine the desired orientation. For example, different reflecting structures 412 of different antennas 302 may cause the incoming signal 310*a* to be directed in different directions, thus requiring different desired orientations. Diverse types of LNBs 409, support arms 411, and other portions of the antenna 302 may also require consideration before a desired orientation may be determined.

To determine the current orientation of the antenna 302, circuitry capable of performing such a task without input from some external source is affixed or attached to the antenna 302 in a fixed orientation relative thereto. In one example, the orientation circuitry resides in the LNB 409, although other locations of the antenna 302, such as the reflecting structure 412 and the support arm 411, may serve as attachment locations for the orientation circuitry. More specifically, the orientation circuitry may be positioned such that the azimuth 420 (e.g., the angular position in the left-right direction), elevation 422 (e.g., the angular position in the up-down direction), and skew 424 (e.g., the angular position of the reflecting surface 414 about an axis extending perpendicular to, and through the center of, the reflecting surface 414) of the antenna 302 relative to the earth, as shown in FIG. 4, may be measured. In some implementations, each of the azimuth 420, elevation 422, and skew 424 of the antenna 302 may be mechanically adjusted by way of hardware coupling the antenna 302 to stable structure, such as a building, fence, pole, or the like.

Figure 5:
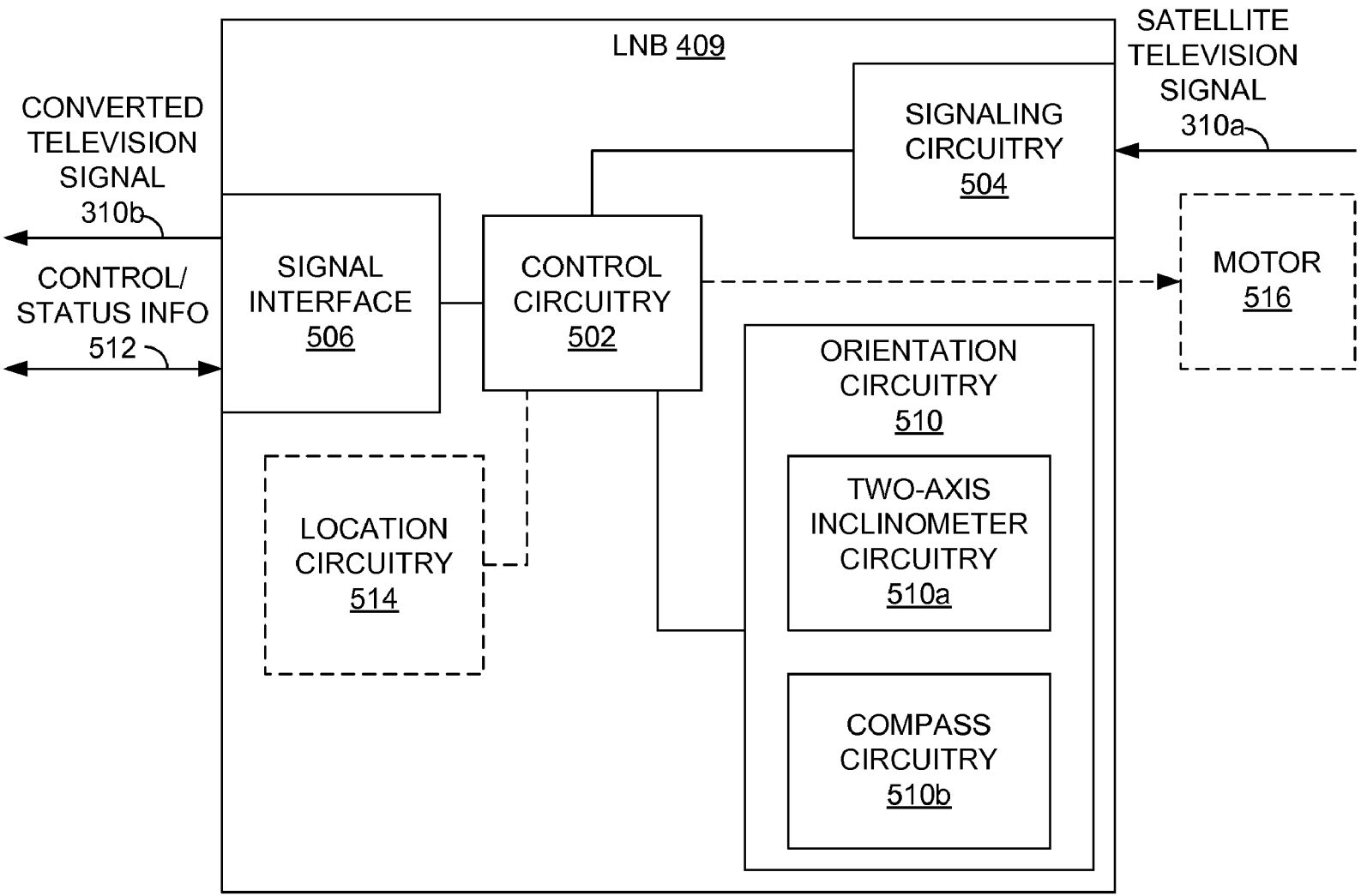
FIG. 5 is a block diagram of a low-noise block converter (LNB) of the antenna of FIG. 4 according to an embodiment of the invention.

An example in which the orientation circuitry is included in the LNB 409 of FIG. 4 is presented in the block diagram of FIG. 5. In this implementation, the LNB 409 includes control circuitry 502, signal conversion/filtering circuitry 504, a signal interface 506, orientation circuitry 510, and possibly location circuitry 514. Other components, such as a power supply, coupler, or converter, may be included, but are not mentioned hereinafter to simplify the following discussion.

The conversion and filtering circuitry 504 is configured to receive or capture the wireless television signal 310*a* from the reflecting surface 414 and perform any conversion, filtering, and other processing of the received signal 310*a* before forwarding the signal by way of the signal interface 506 as the converted television signal 310*b* to the satellite television receiver 304. In one example, the wireless television signal 310*a* is a radio frequency (RF) signal that is down-converted to an intermediate frequency (IF) and transported over coaxial cable to the receiver 304.

The signal interface 506 may also be configured to send and receive control and status information 512 between the control circuitry 502 and the television receiver 304. In one implementation, the signal interface 506 conforms to the Digital Satellite Equipment Control (DiSEqC) communication protocol for the transmission and reception of the control and status information 512, although other protocols or formats may be employed in other embodiments. As is described in greater detail below, the control and status information 512 may be used to transfer information regarding the current orientation of the antenna 302, the current location of the antenna 302, and so on.

The orientation circuitry 510 is configured to determine the current orientation of the antenna 302. In some embodiments, the orientation circuitry 510 may include one or more integrated circuits (ICs) embodying micro-electro-mechanical system (MEMS) technology that detects and measures the angular orientation of the IC relative to the earth. Thus, presuming the orientation circuitry 510 is affixed to the LNB 409 in a fixed or constant orientation relative to the LNB 409, the orientation circuitry 510 is thus configured to provide information quantifying the current orientation of the antenna 302, including its reflecting surface 414, relative to the earth. In the particular example of FIG. 5, the orientation circuitry 510 includes two-axis inclinometer circuitry 510*a* and compass circuitry 510*b*, each of which may be packaged as a separate IC. More specifically, the two-axis inclinometer circuitry 510*a* may be positioned and configured to provide an indication or measurement of both the elevation 422 and skew 424 of the antenna 302 relative to gravity. In other implementations, separate single-axis inclinometer circuits, one each for measuring the elevation 422 and the skew 424 of the antenna 302, may be employed. In complementary fashion, the compass circuitry 510*b* may be positioned and configured to sense the magnetic field of the earth to provide a measurement of the azimuth 420 of the antenna 302 relative to the earth. Depending on the implementation, the two-axis inclinometer circuitry 510*a* and the compass circuitry 510*b* may be packaged in separate ICs, in a single IC, or in some other physical arrangement.

Possibly included in the LNB 409 is location circuitry 514 configured to identify a physical location of the antenna 514. In one example, the location circuitry 514 may be configured to communicate with satellites associated with the Global Positioning System (GPS) to determine the location of the circuitry 514 and, hence, the antenna 302. Other location circuitry 514 configured to determine the location of the antenna 302 may be utilized in alternate implementations.

The control circuitry 502 is configured to control or communicate with each of the components of the LNB 409, such as the signaling circuitry 504, the signal interface 506, the orientation circuitry 510, and, if included, the location circuitry 514. The control circuitry 502 may include one or more processors, such as a microprocessor, microcontroller, or digital signal processor (DSP), configured to execute instructions directing the processor to perform the functions associated with the control circuitry 502. In another implementation, the control circuitry 502 may be completely hardware-based logic, or may include a combination of hardware, firmware, and/or software elements.

In addition, the control circuitry 502 may be configured to control one or more motors 516 coupled with the antenna 302. The motors 516 may be configured to adjust one or more of the azimuth 420, elevation 422, and skew 424 of the antenna 302 based on input the control circuitry 502 provides. As discussed more fully below, the control circuitry 502 may employ the motors 516 to alter the current orientation of the antenna 302 to a more desirable orientation.

Figure 6:
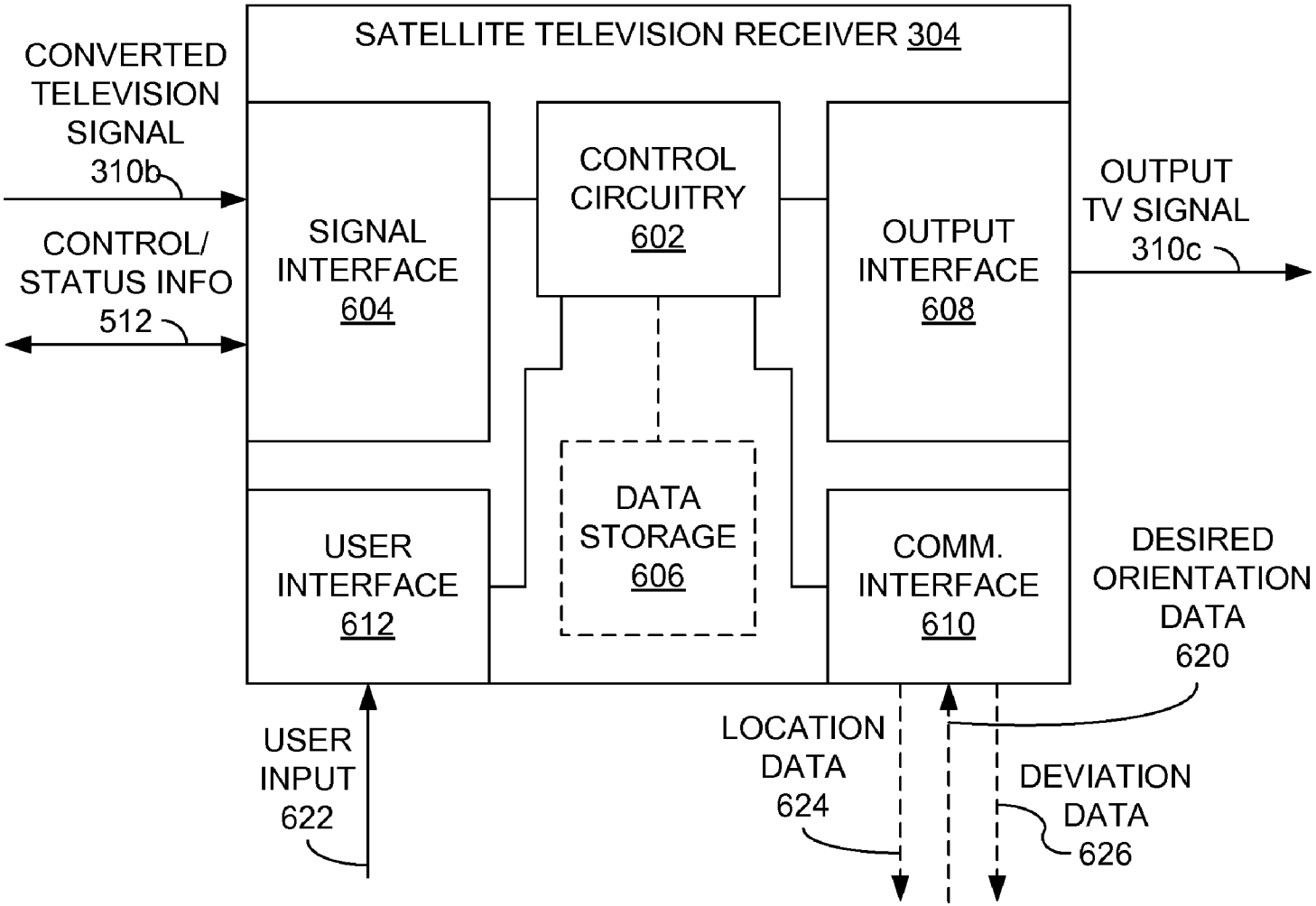
FIG. 6 is a block diagram of a satellite television receiver of the satellite television system of FIG. 3 according to an embodiment of the invention.

Coupled with the signal interface 506 of the antenna 302 is the satellite television receiver 304, an example of which is shown in the block diagram of FIG. 6. In this implementation, the satellite television receiver 304 includes control circuitry 602, a signal interface 604, an output interface 608, a communication interface 610, and a user interface 612. The receiver 304 may also include data storage 606. Other possible components of the receiver 304 may include a power supply, a removable signal processing device ("smart card") interface, and a television signal storage device, such as a digital video recorder (DVR) unit, but such components are not mentioned further herein to simplify the following discussion.

The signal interface 604 of the receiver 304 is configured to receive the converted television signal 310*b* from the antenna 302, perform any processing necessary to select and reformat the signal 310*b* for use by the output interface 608, and transfer the signal to the output interface 608. The signal interface 604 may include one or more tuners allowing a user of the receiver 304 to select particular programming channels of the incoming content in the converted television signal 310*b* for forwarding to the television 306, as well as to an audio receiver or other entertainment system components. The processing of the converted signal 310*b* may include, for example, any decryption, decoding, and/or demultiplexing of the signal 310*b*. In one implementation, the signal 310*b* carries multiple television programming channels whose data is formatted according to one of the Motion Picture Experts Group (MPEG) formats, such as MPEG-2 or MPEG-4, although other television content format standards may be utilized in other embodiments. In another example, if the receiver 304 were configured as a terrestrial television receiver, the signal interface 604 may receive the converted television signal 310*b* via a terrestrial antenna receiving television signals "over the air".

The signal interface 604 is also used to send control information 512 to, and receive status information 512 from, the LNB 409 of the satellite antenna 302. As described more fully below, such information 512 may include current or desired orientation data, geographical or location data, and the like. In one example, the control and status information 512 adheres to the DiSEqC protocol mentioned above.

The output interface 608 provides the converted television signal 310*b*, after any processing by the signal interface 604, as an output television signal 310*c* to the television 306. To that end, the output interface 608 may encode the television content in accordance with one or more television output formats. For example, the output interface 608 may format the content for one or more of a composite or component video connection with associated audio connection, a modulated radio frequency (RF) connection, a High-Definition Multimedia Interface (HDMI) connection, or any other format compatible with the television 306.

In one arrangement, the receiver 304 may include a separate communication interface 610 configured to send and receive one or more types of information, such desired orientation data for the antenna 302, location data, and the like. The communication interface 610 may be any interface configured to communicate via a network, such as the Internet or other wide-area network (WAN), a public switched telephone network (PSTN), a cellular communication network, or the like. Examples of the communication interface 610 may include, but are not limited to, an IEEE 802.11 (i.e., Wi-Fi), Ethernet, Bluetooth®, or HomePlug® interface to a telephone line, or to a cable or Digital Subscriber Line (DSL) gateway for accessing the Internet or another WAN.

To allow a user of the receiver 304 to control the selection of the television content from the converted television signal 310*b*, as well as perform other operations typically associated with a television receiver 304, the user interface 612 may facilitate the entry of commands by way of user input 622. In many examples, the user interface 612 may be a remote control interface configured to receive such input 622 by way of infrared (IR), radio frequency (RF), acoustic, or other wireless signal technologies. To facilitate such information entry, the receiver 304 may provide a menu system presented to the user via the television 306. In some implementations, the user interface 612 may also include any of a keyboard, mouse, and/or other user input device.

The receiver 304 may also include data storage 606 for storing one or more types of data or information, such as orientation and location data associated with the antenna 302. The data storage 606 may include any kind of volatile data memory (such as static random-access memory (SRAM) and dynamic random-access memory) and/or non-volatile memory (including, but not limited to, flash memory, hard disk drive storage, optical disk storage, removable storage devices, memory cards, and Universal Serial Bus (USB) drives).

The control circuitry 602 is configured to control and/or access other components of the receiver 304, including, but not limited to, the signal interface 604, the data storage 606 (if included), the output interface 608, the communication interface 610, and the user interface 612. The control circuitry 602 may include one or more processors, such as a microprocessor, microcontroller, or DSP, configured to execute instructions directing the processor to perform the functions associated with the control circuitry 602. In another implementation, the control circuitry 602 may be completely hardware-based logic, or may include a combination of hardware, firmware, and/or software elements.

In operation, the control circuitry 502 of the LNB 409 communicates with the orientation circuitry 510 to receive information describing the current orientation of the antenna 302 according to at least one of the azimuth 420, elevation 422, and skew 424 of the antenna 302. The control circuitry 502 may then transfer the current orientation data as control/status information 512 to the satellite television receiver 304 via the signal interface 506. In one implementation, the control circuitry 502 may also obtain geographical location information from the location circuitry 514 and transfer the location information to the receiver 304 over the signal interface 506.

Correspondingly, the control circuitry 602 of the receiver 304 receives the current orientation information from the antenna 302 via its signal interface 604. The control circuitry 602 may also receive the geographical location data from the antenna 304, as indicated above. In another implementation, the control circuitry 602 may receive the location data 624 for the location of the antenna 302 from a separate communication node 308 (shown in FIG. 3) via the communication interface 610. In another alternative, the location data may have been stored previously in the data storage 606 of the receiver 304, such as by way of a user or installer. In another example, the receiver 304 may include location circuitry similar to that shown in the LNB 409 from which the control circuitry 602 may obtain location data indicating the geographical location of the receiver 304. In that situation, the receiver 304 is presumed to be located close enough to the antenna 302 that the location of the receiver 304 is virtually the same as that of the antenna 302, which may be true in an overwhelming majority of embodiments.

Depending on the particular implementation, the geographical or location data 624 may represent the location of the antenna 302 by way of latitude and longitude, street address, ZIP code, or some other format. The precision of the location data necessary may depend on a number of factors, including the nature of the communication signals carried via the antenna 302, the structure of the antenna 302 itself, and other factors.

Based on the location data 624, the control circuitry 602 determines at least one desired orientation for the antenna 302. More specifically, assuming a particular satellite 301 residing in geosynchronous orbit, the geographical location of the antenna 302 determines the orientation of the antenna 302 necessary to align the antenna 302 correctly with the satellite 301. In some cases, the antenna 302 may be aligned to communicate with multiple satellites 301 in different locations in the sky simultaneously, presuming the LNB 403 is configured to receive and process the signals from the multiple satellites 301.

In one implementation, the control circuitry 602 transmits the location data 624 to a remote communication node 308, which receives the location data 624, determines the desired orientation data 620, and returns the desired orientation data 620 to the receiver via the communication interface 610. The remote communication node 308 may determine this desired orientation data 620 by way of a lookup table listing a variety of possible locations and associated desired orientations of the antenna 302. In another embodiment, the remote communication node 308 may calculate the desired orientation data 620 of the antenna 302 using the location data 624 as input. In other implementations, the control circuitry 502 may perform the necessary calculations or table lookup operations using the location data 624 to generate the desired orientation data 620. For example, the data storage 606 may store the lookup tables or orientation formulas for access by the control circuitry 602 to retrieve or generate the desired orientation data 620.

Once the desired orientation data 620 is determined, the control circuitry 602 may compare the desired orientation data 620 with the current orientation data received from the antenna 302. Based on this comparison, the control circuitry 602 may generate alignment information as to whether the current antenna orientation aligns with its desired orientation. In one implementation, the control circuitry 602 determines that the current orientation aligns with the desired orientation if the current orientation data is within some error percentage or level of the desired orientation data. For example, if the current orientation data for each axis of interest (i.e., azimuth 420, elevation 422, and/or skew 424) is within some predefined fraction of a degree of the corresponding portion of the desired orientation data, the control circuitry 602 may consider the antenna 302 to be aligned with its desired orientation.

Based on the comparison, the control circuitry 602 may generate some indication in the form of alignment information as to whether the antenna 302 aligns with its desired orientation. In one implementation, the control circuitry 602 may merely generate a yes-or-no indication. In other embodiments, the control circuitry 602 may produce more descriptive deviation data 626 indicating the difference between the current and desired orientations for each of the azimuth, elevation, and skew components.

In some cases, the control circuitry 602 may transmit the deviation data 626 and/or the current orientation data to the remote communication node 308 via the communication interface 610. Further, such information may be generated periodically, or at the request of the control circuitry 602 or the remote communication device 308, thus providing an indication of the current orientation of the antenna 302 compared to its desired orientation over some period of time, such as days or weeks. The remote communication node 308, such as that operated by a service provider responsible for installing and maintaining the receiver 304, may then use this information to determine if the initial installation and orientation of the antenna 302 was incorrect, or if the orientation of the antenna 302 is deviating from its desired orientation over a period of time. Further, such information from the receiver 304 may be combined with corresponding information from multiple other receivers 304 to allow the service provider to determine whether the overall scope of alignment problems may be isolated to particular installations, specific installers, or indicative of a general antenna design defect or anomaly in the transmission satellite 301.

The deviation data 626 and/or the current orientation data may condition or "gate" other information available to the control circuitry 602 to more accurately interpret that information. For example, the control circuitry 502 of the antenna 302 may generate and transmit a value indicating the relative signal strength of the satellite television signal 310*a* received at the LNB 409 as status information 512 via the signal interfaces 506, 604 to the control circuitry 602 of the receiver 304. The control circuitry 602 may then compare the signal strength value to a signal strength threshold, which may be received by the communication interface 610 or previously stored in the data storage 606. If the signal strength value is less than the threshold, and the antenna 302 is not aligned according to its desired orientation, the control circuitry 602 may generate an indication that the signal strength is less than desirable because the antenna is misaligned. If, instead, the antenna 302 is not misaligned, the control circuitry 602 may generate an indication that the signal strength is low due to some reason other than a misaligned antenna 302, such as poor atmospheric conditions or a physical obstruction of the path between the antenna 302 and the satellite 301. In other implementations, the control circuitry 602 provides the deviation data 626 and/or the current location data along with the signal strength value via the communication interface 610 to the remote communication node 308, which may then determine whether a low signal strength condition exists, as well as a possible cause for that condition.

The current orientation data may also be used in conjunction with the location data 624 to ascertain whether the antenna 302 (and, thus, the receiver 304) is located at the location identified with the subscriber associated with the receiver 304. To this end, the control circuitry 602 may transfer the current orientation data for the antenna 302 via the communication interface 610 to the remote communication node 308, which may compare that data with location data 624 that was either received from the receiver 304 or previously known. Based on this comparison, the node 308 may determine that the current orientation data does not correspond with the location in which the receiver 304 is to be deployed, assuming the antenna is correctly aligned with a satellite 301 of interest. Further, the control circuitry 602 may forward the signal strength value mentioned above to validate that the current antenna orientation is correct. If the location data 624 thus indicates a location not in agreement with the current operational antenna orientation, the node 308 may presume that the receiver 304 is located in an area not corresponding with the address of the subscriber. Such an event may occur when several geographically separated users sign up for satellite television service under a single subscriber to receive an unauthorized discount on service subscription fees. In one implementation, in response to determining that receiver is not located in the expected geographic location, the remote communication node 308 may at least partially disable the receiver 304. In other arrangements, the control circuitry 602 of the receiver 304 may perform these functions instead of the node 308.

The current orientation data generated at the orientation circuitry 510 may also be employed to assist an installer of the antenna 302 in accurately orienting the antenna 302. In one example, the installer may communicatively couple a small communication device, such as a handheld device with a visual display, with the LNB 409. The coupling may be performed by way of the signal interface 604 or a separate communication interface provided at the LNB 409, such as a USB (Universal Serial Bus) interface (not shown in FIG. 5). In this embodiment, the handheld device may provide ongoing feedback as to the current orientation of the antenna 302 while the installer adjusts the antenna 302 orientation. The handheld device may also provide data indicating the difference between the current antenna 302 orientation and its desired orientation, either visually or via an audible tone.

If the antenna 302 is equipped with one or more motors 516 for altering one or more of the azimuth 420, elevation 422, and skew 424 of the antenna 302, the deviation data 626 described above may be employed to alter the current antenna 302 orientation by activating the motors 516 to reorient the antenna 302 to the desired direction. The amount of rotation imparted on the antenna 302 may be determined by the deviation data 626 described above. By comparing the current orientation data with the desired orientation data 620, and then employing the motors 516 to align the antenna 302 according to the desired orientation data 620, in a periodic manner, misalignments of the antenna 302 due to windy conditions, impromptu physical contact with the antenna 302, mechanical fatigue, and the like may be corrected promptly.

If the antenna 302 may be directed to another satellite 301 different from the satellite 301 to which the antenna 302 is current directed, the control circuitry 602 may generate or obtain the desired orientation data 620 for the new satellite 301 using the current location data 624 by any of the processes described above. Once the new desired orientation data 620 is acquired, the control circuitry 602 may activate the one or more motors 516 to direct the antenna 302 to the new satellite 301.

In other examples, the control circuitry 602 may use the current orientation data and the desired orientation data 620 to update the orientation of the antenna 302 in mobile applications, such as receivers 304 and antennae 302 employed in aircraft, ground transportation, and similar applications. In such cases, the current orientation data and the location data 624 employed to determine the desired orientation data should be updated regularly to address the rate at which the desired antenna 302 orientation may change. In some cases, the control circuitry 602 may employ a predictive algorithm based on the current speed and direction indicated by recent history of changes in the location data 624 to anticipate the motor 516 control necessary to maintain the desired antenna orientation.

In other implementations, the receiver 304 may communicate with a satellite 301 that is not in geosynchronous orbit. In such cases, the desired orientation of the antenna 302 may change over time, even if the receiver 304 is stationary. To address this scenario, the control circuitry 602 may periodically or continuously receive or generate new desired orientation data 620 based on a current time value and the location of the antenna 302. The desired orientation data 620 then be used to alter the current orientation of the antenna 302 over time via the control circuitry 502 of the antenna 302 and the motors 516 coupled thereto.

While the majority of the implementations described above utilize the control circuitry 602 of the satellite television receiver 304 to provide the majority of the functionality in determining the current orientation of the antenna 301, and possibly adjusting the antenna 302 orientation accordingly, this functionality may reside, in whole or in part, among the control circuitry 502 of the LNB 409, the control circuitry 602 of the receiver 304, and control circuitry residing in the remote communication node 308. For example, desired orientation data 620 received from the remote communication node 308 or generated within the receiver 304 may be passed to the control circuitry 502 of the LNB 409 via the signal interfaces 506, 604. The control circuitry 502 may then generate the indication as to whether the antenna 302 is misaligned. In another example, the current orientation data, possibly along with the location data 624, may be transmitted from the LNB 409 through the receiver 304 to the remote communication node 308. The node 308 may then compare the current orientation data with the desired orientation data 620 to establish whether the antenna 302 is oriented as desired.

At least some embodiments as described herein thus facilitate detection and possible correction of communication antenna misalignment using orientation-detecting circuitry mounted on the antenna. Use of such angular measurement of the antenna orientation provides a direct means of orientation determination, unlike the use of proxies such as communication signal strength. As a result, fewer customer service calls may be necessary, as fewer cases of signal strength reduction will be identified as a misaligned antenna. Further, in many cases, the use of orientation circuitry may result in detection of antenna misalignment prior to any effect on signal strength or other orientation proxies, thus likely providing a detection and correction mechanism with a response time fast enough to be employed in mobile communication applications.

While several embodiments of the invention have been discussed herein, other implementations encompassed by the scope of the invention are possible. For example, while various embodiments have been described largely within the context of satellite television receivers or set-top boxes, other electronic devices engaging in wireless directional signal transmission and/or reception, such as terrestrial television set-top boxes, mobile communication devices, and the like, may incorporate various aspects of the functionality described above to similar effect. In addition, aspects of one embodiment disclosed herein may be combined with those of alternative embodiments to create further implementations of the present invention. Therefore, while the present invention has been described in the context of specific embodiments, such descriptions are provided for illustration and not limitation. Accordingly, the proper scope of the present invention is delimited only by the following claims and their equivalents.

What is claimed is:

1. A method of determining a current orientation of an antenna compared to a desired orientation, the method comprising:

in circuitry mounted to a low-noise block-converter (LNB), wherein the circuitry is in a fixed orientation relative to the antenna, determining elevation and skew information from at least one inclinometer, and determining azimuth information from a compass, wherein the least one inclinometer and the compass reside in the circuitry, generating current orientation data indicating the current orientation of the antenna, wherein the current orientation data is determined from the determined elevation, skew and azimuth;

receiving desired orientation data indicating the desired orientation for the antenna based on a geographical location of the antenna;

comparing the desired orientation data with the current orientation data; and generating alignment information as to whether the current orientation of the antenna aligns with the desired orientation of the antenna based on the comparison.

2. The method of claim 1, wherein:

the current orientation data comprises a current azimuth value, a current elevation value, and a current skew value for the antenna as determined by the inclinometer and the compass of the circuitry mounted to the LNB;

the desired orientation data comprises a desired azimuth value, a desired elevation value, and a desired skew value for the antenna; and the current orientation aligns with the desired orientation of the antenna when the current azimuth value is within a first error value of the desired azimuth value, the current elevation value is within a second error value of the desired elevation value, and the current skew value is within a third error value of the desired skew value.

3. The method of claim 1, wherein receiving the desired orientation data comprises:

based on geographical data corresponding to the geographical location of the antenna, extracting the desired orientation data from a data structure comprising information indicating a desired antenna orientation for each of a plurality of geographical locations.

4. The method of claim 1, wherein receiving the desired orientation data comprises:

transmitting geographical data corresponding to the geographical location of the antenna to a remote communication node; and receiving the desired orientation data from the remote communication node, the desired orientation data determined at the remote communication node in response to receiving the transmitted geographical data.

5. The method of claim 4, further comprising:

in response to determining that the geographical location of the antenna does not correspond to a location identified with a subscriber, at least partially disabling a receiver that receives a signal from the LNB.

6. The method of claim 5, wherein determining that the geographical location of the antenna does not correspond to the location identified with the subscriber occurs at the remote communication node.

7. The method of claim 5, wherein determining that the geographical location of the antenna does not correspond to the location identified with the subscriber occurs at the receiver.

8. The method of claim 1, wherein:

the alignment information comprises a binary indication as to whether the current orientation of the antenna aligns with the desired orientation of the antenna.

9. The method of claim 1, wherein:

the alignment information comprises at least one value quantifying a difference between the current orientation of the antenna and the desired orientation of the antenna.

10. The method of claim 1, further comprising:

receiving a signal strength value indicating a strength of a signal received via the antenna;

receiving a signal strength threshold value; and generating an indication that the signal strength is reduced for a reason other than the antenna being misaligned if the alignment information indicates the antenna is aligned according to its desired orientation, and the signal strength value is below the signal strength threshold value.

11. The method of claim 1, further comprising:

if the alignment information indicates the current orientation of the antenna does not align with the desired orientation of the antenna, activating at least one electric motor to align the antenna based on the alignment information.

12. A communication antenna, comprising:

a mechanical structure defining an angular orientation of the communication antenna;

a signaling structure affixed to the mechanical structure, wherein signaling structure is in a fixed orientation relative to the communication antenna;

signaling circuitry in the signaling structure, the signaling circuitry configured to at least receive reflected wireless signals from the communication antenna;

orientation circuitry in the signaling structure, the orientation circuitry configured to generate current orientation data indicating the angular orientation of the communication antenna relative to a reference orientation;

a signal interface in the signaling structure, the signal interface configured to communicate a signal corresponding to the received reflected wireless signals to a receiver; and control circuitry configured to transfer the current orientation data from the orientation circuitry to the receiver, and configured to receive alignment information from the receiver, wherein the alignment information corresponds to a difference between the current orientation of the communication antenna and a desired orientation of the communication antenna that is based on a location of at least the antenna.

13. The communication antenna of claim 12, wherein:

the current orientation data comprises at least one of a current azimuth value, a current elevation value, and a current skew value relative to the reference orientation.

14. The communication antenna of claim 12, wherein:

the orientation circuitry comprises two-axis inclinometer circuitry for determining a current elevation value and a current skew value for the communication antenna.

15. The communication antenna of claim 12, wherein:

the orientation circuitry comprises compass circuitry for determining a current azimuth value for the communication antenna.

16. The communication antenna of claim 12, further comprising:

at least one motor coupled to the mechanical structure and configured to alter at least one of an azimuth, an elevation, and a skew of the current orientation of the communication antenna;

wherein the control circuitry is configured to control the at least one motor to align the current orientation of the communication antenna to a desired orientation of the communication antenna based on the current orientation data and desired orientation data indicating the desired orientation of the communication antenna.

17. The communication antenna of claim 16, further comprising:

location circuitry configured to generate current location data indicating the current location of the communication antenna, wherein the current location data is determined via communication with a global positioning system, and wherein the signal interface is configured to transfer the current location data to the communication device.

18. A device affixed to a structure supporting an antenna, wherein a communication device is in a fixed orientation relative to the antenna, the communication device comprising:

a signal interface configured to communicate a signal to a remote communication node, the signal corresponding to at least reflected signals received from the antenna;

orientation circuitry configured to generate current orientation data indicating current orientation of the antenna; and control circuitry configured to:

receive the current orientation data indicating the current orientation of the antenna;

compare the current orientation data with desired orientation data indicating a desired orientation for the antenna, wherein the desired orientation for the antenna is received from the remote communication node, and wherein the desired orientation for the antenna is based on a current location of the antenna and location of at least one satellite; and generate deviation information indicating whether the current orientation aligns with the desired orientation within a predetermined limit based on the current orientation data and the desired orientation data.

19. The device of claim 18, wherein the control circuitry is configured to:

periodically repeat receiving the current orientation data and comparing the current orientation data with the desired orientation data; and generate new deviation information for each repetition to the remote communication node via the signal interface to identify orientation changes of the antenna.

20. The device of claim 18, further comprising:

location circuitry configured to determine a location indicating a current location of the antenna, wherein the control circuitry is further configured to transmit current location data indicating a current location of the antenna to the communication node; and wherein the control circuitry receives the desired orientation data from the communication node after transmitting the current location data.

21. The device of claim 18, comprising:

data storage configured to store multiple entries of desired orientation data and geographic location data, wherein each entry of desired orientation data is associated with a corresponding entry of the geographic location data;

wherein the control circuitry is configured to compare the determined location indicating the current location of the antenna with the geographic location data to determine the desired orientation data for the current location of the antenna.

* * * * *

UNITED STATES PATENT AND TRADEMARK OFFICE

CERTIFICATE OF CORRECTION

PATENT NO. : 8,284,112 B2
APPLICATION NO. : 12/796542
DATED : October 9, 2012
INVENTOR(S) : Otto et al.

It is certified that error appears in the above-identified patent and that said Letters Patent is hereby corrected as shown below:

In Column 12, Line 15, prior to the word "least" please insert the word --at--

Signed and Sealed this
Twelfth Day of March, 2013

Teresa Stanek Rea
*Acting Director of the United States Patent and Trademark Office*